US012397242B2

(12) United States Patent
Leneweaver

(10) Patent No.: US 12,397,242 B2
(45) Date of Patent: Aug. 26, 2025

(54) TRACK HURDLE ASSEMBLY

(71) Applicant: Robert Leneweaver, Havertown, PA (US)

(72) Inventor: Robert Leneweaver, Havertown, PA (US)

( * ) Notice: Subject to any disclaimer, the term of this patent is extended or adjusted under 35 U.S.C. 154(b) by 141 days.

(21) Appl. No.: 18/477,109

(22) Filed: Sep. 28, 2023

(65) Prior Publication Data

US 2024/0115969 A1 Apr. 11, 2024

Related U.S. Application Data

(60) Provisional application No. 63/414,015, filed on Oct. 7, 2022.

(51) Int. Cl.
*A63K 3/04* (2006.01)

(52) U.S. Cl.
CPC ..... *A63K 3/043* (2013.01)

(58) Field of Classification Search
CPC ..... A63K 3/04; A63K 3/043; A63K 3/046
See application file for complete search history.

(56) References Cited

U.S. PATENT DOCUMENTS

| | | | | |
|---|---|---|---|---|
| 3,366,381 | A * | 1/1968 | Ross | A63K 3/043 482/17 |
| 3,384,367 | A * | 5/1968 | Baum | A63K 3/043 482/17 |
| 7,785,233 | B1 * | 8/2010 | Moore | A63K 3/043 482/17 |
| 9,561,450 | B1 * | 2/2017 | Chung | A63K 3/043 |
| 2020/0122051 | A1 * | 4/2020 | Covalschi | A63B 69/0028 |

OTHER PUBLICATIONS

Mahoney, Travis, "DIY PVC Adjustable Hurdle for Under $15," YouTube, Travis Mahoney, uploaded Apr. 26, 2020, <https://www.youtube.com/watch?v=A7gqbEwjAPU>.

* cited by examiner

*Primary Examiner* — Zachary T Moore
(74) *Attorney, Agent, or Firm* — Flaster Greenberg PC

(57) ABSTRACT

A huddle assembly is provided having a base, two upright members, and a cross bar extending between the two upright members. The cross bar includes a first bar member and a second bar member. An attachment member temporarily secures the two bar members together to form a continuous bar. The two bar members are pivotably supported on a respective upright member. The temporary attachment of the two bar members permits their separation upon contact by a runner. The pivotable attachment to the uprights permits the rotation of the bar members, during separation, about a vertical axis of the upright members.

22 Claims, 8 Drawing Sheets

TRACK HURDLE ASSEMBLY

CROSS REFERENCE TO RELATED APPLICATIONS

The present application claims the benefit of the filing of U.S. Provisional Application No. 63/414,015, filed Oct. 7, 2022, the disclosure of which is herein incorporated by reference.

BACKGROUND

An event in track and field competition is a race using hurdles that are spaced along a running track. The runner must stride over the hurdles while maintaining proper step cadence.

SUMMARY

The present assembly is a track hurdle having a cross bar that separates and pivots when contacted during use. The cross bar becomes a gate that opens when contacted, allowing the runner to practice hurdling without incurring any significant impact when not completing the stride over the cross bar. The assembly is preferably portable and easily assembled.

In embodiments, a hurdle assembly includes a base, two upright members and a cross bar suspended between the two uprights. Each upright member is preferably fixed on an opposite side of the base. The cross bar may include a first bar member and a second bar member each pivotably supported on a respective upright member. The two bar members are linearly aligned between their pivot mountings. A striking force on the cross bar causes a separation of the two bar members, with the each bar members pivoting away from the alignment on their upright support. The assembly may further include an attachment member that releasably secures the two bar members together. The striking force causes a separation of the attachment member from at least one bar member so as to permit the pivoting of the bar members about their respective mountings.

A huddle assembly may be provided with a fixed base, two upright members projecting vertically from the base, and a cross bar extending horizontally between and preferably perpendicular to the upright members. The cross bar may include a first bar member and a second bar member, with the two bar members being pivotably supported on a respective upright member for rotation preferably about a vertical axis. An attachment member temporarily secures the two bar members together with a friction fit to form the linear cross bar. The temporary attachment of the two bar members permits their separation upon contact by a runner and the pivotable attachment permits the outward rotation of the bar members.

The bar members are of the cross bar are preferably made of a soft foam material. The upright members may include a telescoping structure, with an outer collar co-axially aligned with a post member. The post member may be fixed to the base and project vertically upward therefrom. The base may be formed from a bottom bar having a base member attached at each end thereof and a leg member projecting rearwardly, preferably perpendicular to the bottom bar. Stabilizing foot members may be provided forward of the base members, and preferably axially aligned with the leg members. Height adjustment means may be provided as part of the uprights. The height adjustment means may be frictionally engaged on a post portion of the uprights and support the telescoping collar. Movement of the adjustment mean along the post members adjust the relative height of the cross bar above the base member. The adjustment means may include a clamp structure for frictionally engaging the post member.

The pivotable support may be formed by corner members fixed to a rotational collar that is telescopically formed as part of the upright members. The bar members are preferably attached to the corner members and directed horizontally, in a perpendicular relation with the uprights.

The pivotable support may be formed by corner members, with one or more rotationally mounted to an upright member. The pivot mounting may be formed by an insert flange telescopically positioned within a portion of the upright members. The bar members are preferably attached to the corner members and directed horizontally, in a perpendicular relation with the uprights.

The bar members are preferably attached to the corner members by a friction fit. The fiction fit of bar members with the corner members is preferably being greater than the friction fit of the bar members with the attachment member.

In embodiments, a gated cross bar may be fixed to the uprights of an existing hurdle assembly as a replacement for the existing fixed cross bar. The cross bar may include a first bar member and a second bar member each attached to corner pivot that may be secured to the existing uprights. The two bar members are linearly aligned between their corner pivot members. The gated assembly includes an attachment member that releasably secures the two bar members together. The bar members are preferably made of a soft foam material and frictionally engage the attachment member. The attachment member is preferably inserted into one end of each bar member and preferably positioned at the center of the cross bar. A striking force causes a separation of the attachment member from at least one bar member so as to permit the pivoting of the bar members about their respective corner pivots. The gated bar assembly permits the adaption of the separable and pivoting cross bar to existing hurdles.

DETAILED DESCRIPTION

Figure 1:
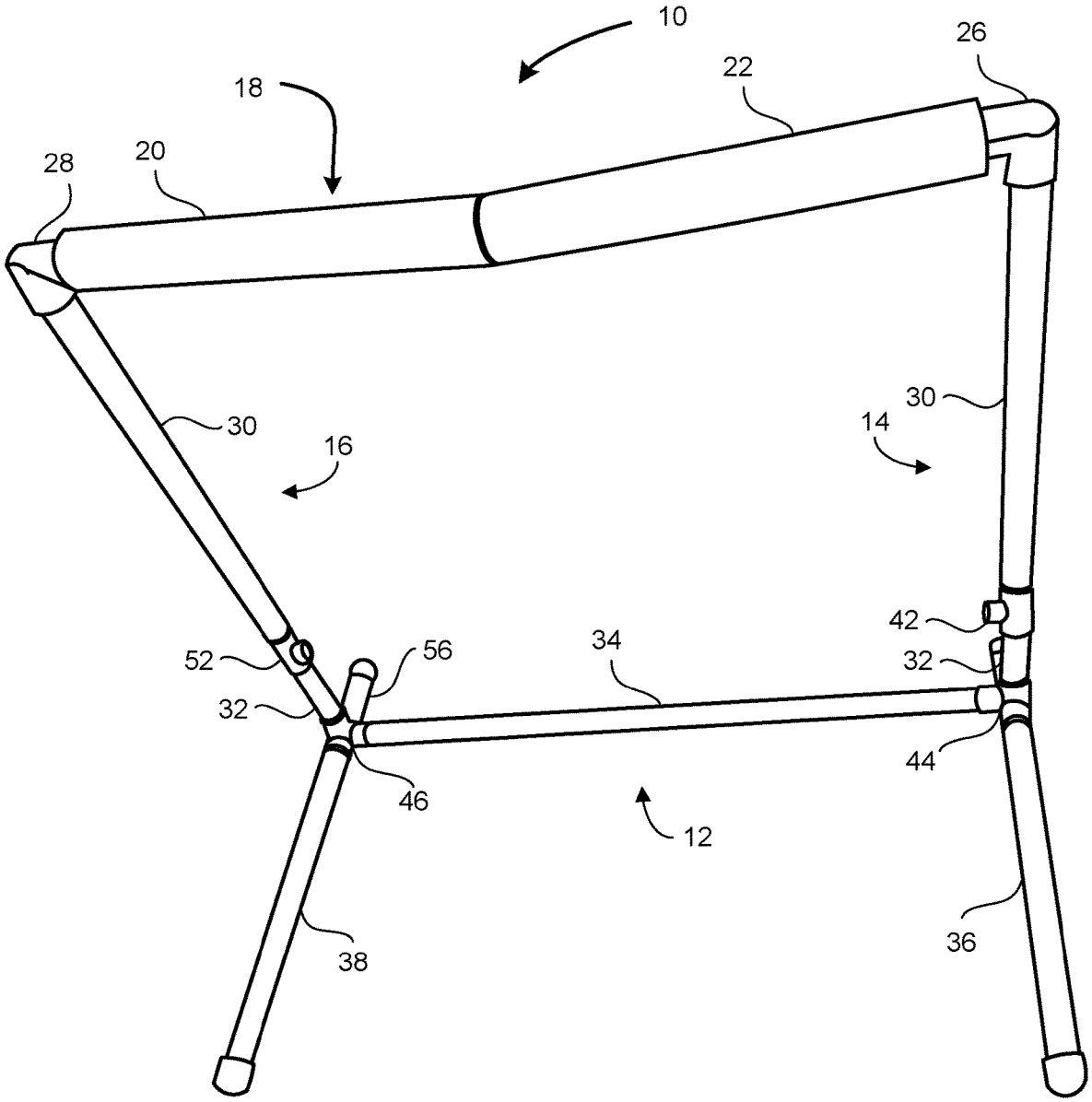
FIG. 1 shows a perspective view of an embodiment of a hurdle assembly.

In the various figures, like numbers are intended to identify similar elements in the assembly. In FIG. 1 there is shown a hurdle assembly that is generally identified by the number 10. The assembly 10 is formed by a base 12, two uprights 14, 16 and a cross bar or cross bar 18. The cross bar 18 as shown incudes two bar members 20, 22 that project from opposing corner members 26, 28. The corner members 26, 28 are provided respectively at the top of the uprights 14, 16. The uprights 14, 16 each include an outer collar 30 that is telescopically positioned over an inner post 32. The collar 30 preferably has an inside diameter that is greater than the outside diameter of the post 32, such that the collar 30 may both rotate about a vertical axis of the post 32 and move longitudinally up and down along the post 32. A similar collar 30 and post 32 assembly is contemplated to be provided for upright 14 on the opposite side of the assembly. In the embodiment of FIG. 1, the corner members 26, 28 are positioned at the top end of their respective uprights 14, 16, with the collar portions 30 fitting over their respective post members 32. The corner members 26, 28 are preferably pivotally secured to their respective uprights 14, 16.

The base 12 of the assembly 10 is formed by a bottom bar 34 and two legs 36, 38. The legs 36, 38 project rearwardly from respective base members 44, 46 and are attached at opposite ends to the bottom bar 34. The legs 36, 38 are respectively fixed to the end member 44, 46 on opposite sides of the base 12. The legs 36, 38 and post members 32 are preferably attached to the base members 44,46 by a friction fit. The friction fit is contemplated to provide stability to the assembly 10, while permitting relatively easy removal for dismantling/disassembly.

Figure 2:
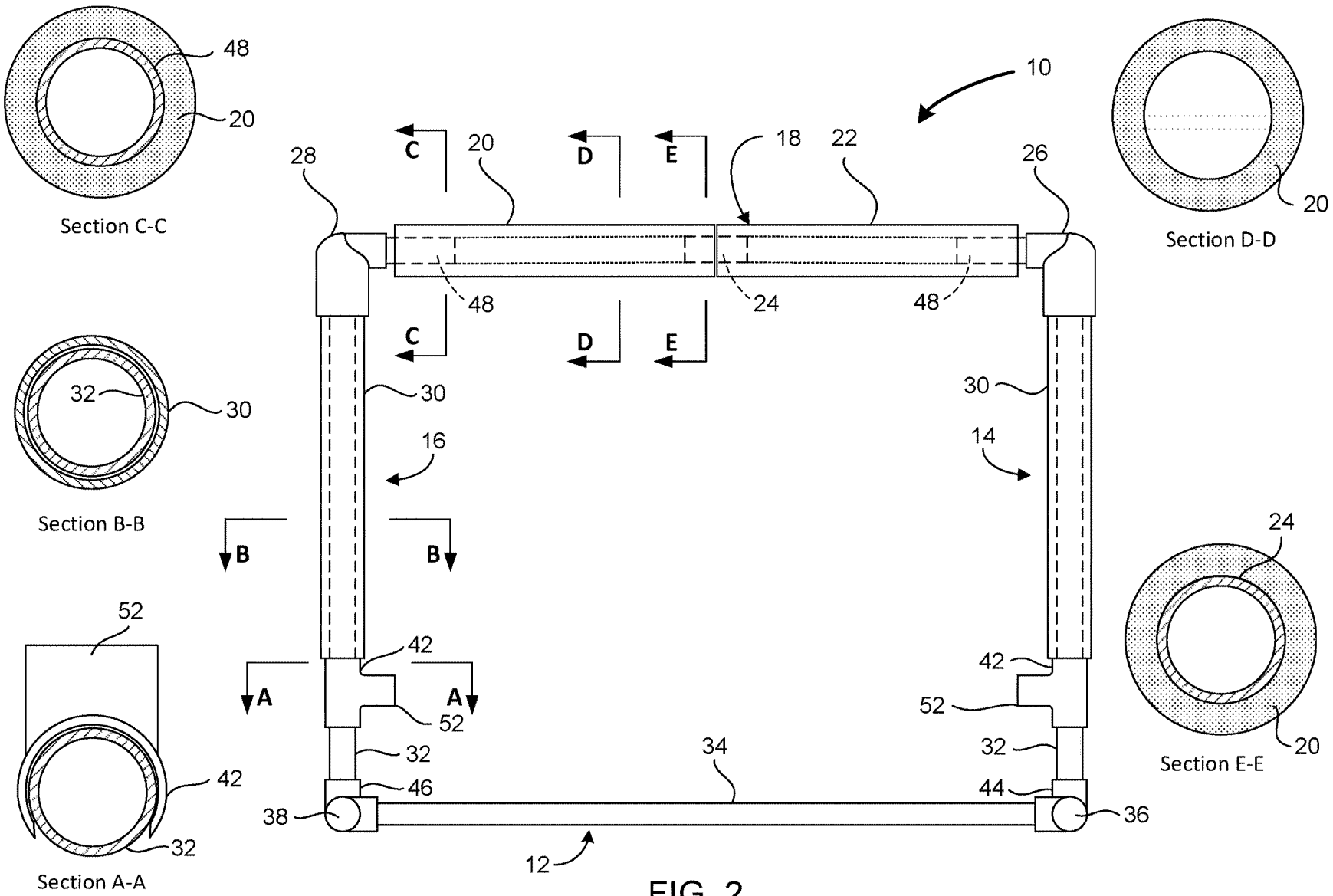
FIG. 2 shows a rear elevation view of the hurdle assembly embodiment shown in FIG. 1. A number of cross section views are shown, including Section A-A as taken along line A-A, Section B-B as taken along line B-B, Section C-C as taken along line C-C, Section D-D as taken along line D-D, and Section E-E as taken along line E-E.
Figure 6B:
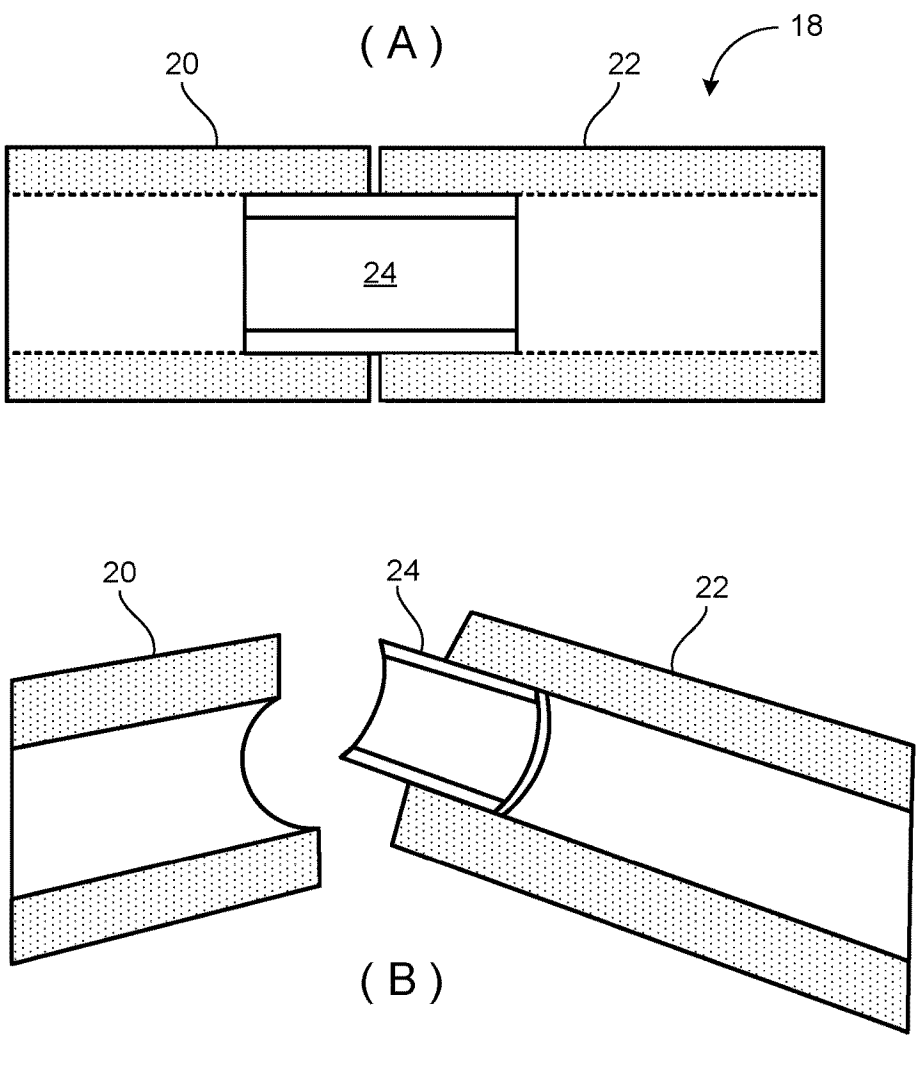
FIG. 6B shows partial views of the elements of the cross bar assembly as taken from FIGS. 3A and 3B, respectively.

Also illustrated in FIG. 2, the cross bar 18 is formed by two bar members 20, 22, with an attachment member 24 provided therebetween. The bar members 20,22 are hollow, as represented by section D-D. The attachment member 24 is positioned within the hollow ends of bar members 22, 24. This relationship is shown in Section E-E and in FIG. 6B. A portion of member 24 is inserted into the center end of each bar member 20, 24 to form the cross bar 18. The attachment member 24 temporarily fixes the bar members 20, 22 together. As is discussed further below, the bar members 20, 22 may separate or split, with each bar member pivoting away about their respective uprights 14, 16. One collar portion 30 is attached to a respective corner member 26, 28. The outside ends of the bar members 18, 20 are fixed to their respective corner members 26, 28 by the flange 48. The flange 48 is inserted into the hollow of the outside ends of the respective bar member 20, 22. The inserted position of the flange 48 is shown in section C-C.

Figure 3:
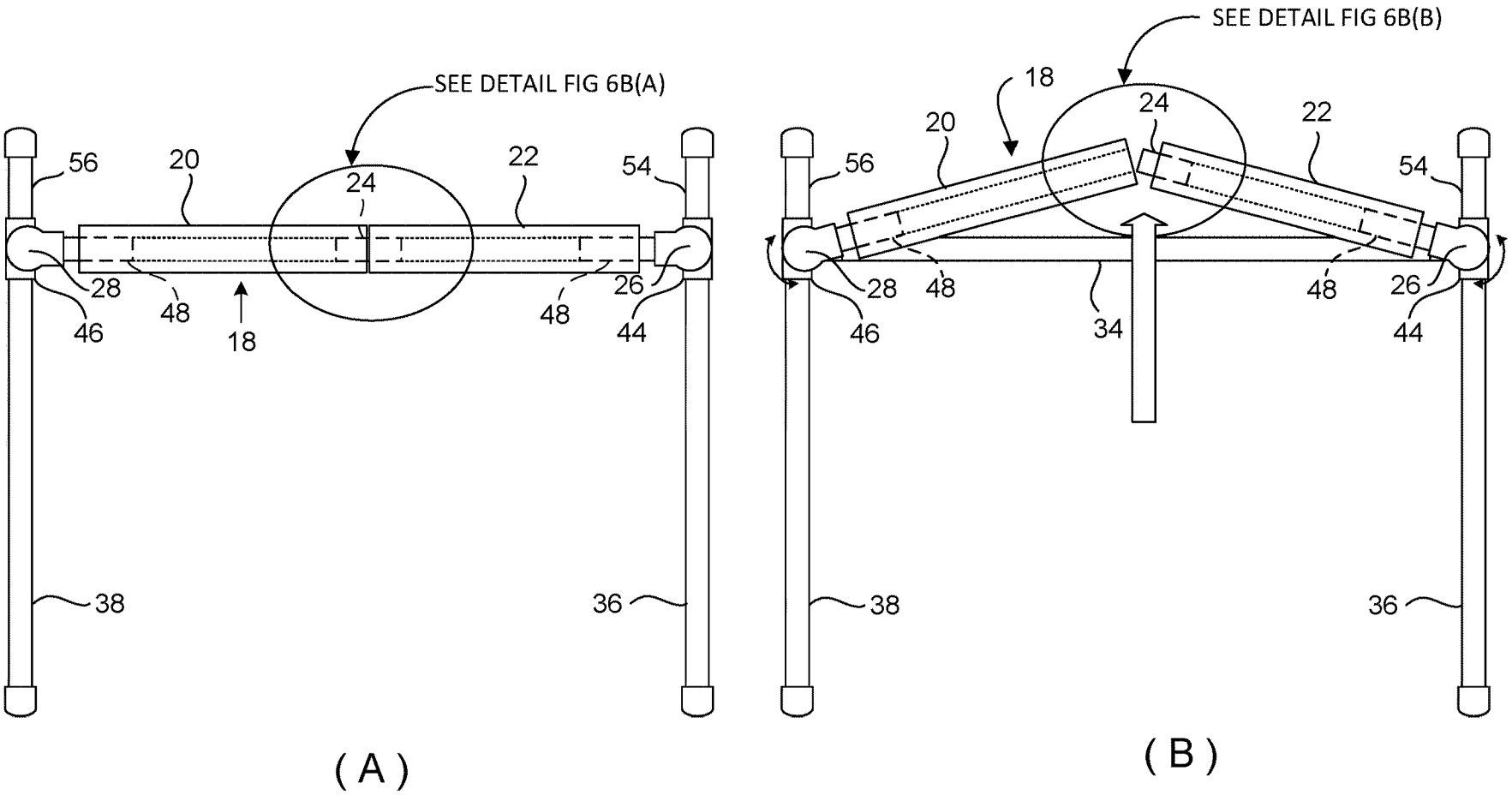
FIG. 3, parts (A) and (B), show a top plan view of the hurdle assembly of FIGS. 1 and 2.

In the top views of the assembly in FIG. 3, the cross bar 18 is shown in the operative position. In part (A), the two bar portions 20, 22 are fixed together by attachment member 24. The detail of the assembly is further illustrated in the cross section of FIG. 6B, part (A). The two bar portions 20, 22 are hollow, having an inner diameter. The attachment 24 is inserted into the respective (central) ends and creates a friction fit. When separated (see, e. g., part (B) of both FIGS. 3 and 6B) the attachment member 24 slides out of one of the bar portions—shown as bar 20—and remains positioned in the end of the other bar portion 22. In FIG. 3, part (A), the assembled cross bar 18 is fixed to the uprights (14, 16) by corner members 26, 28. The corner members 26, 28 include the projecting flange 48 that fits within the respective (outer) ends of the bar members 20, 22. See also the partial view of FIG. 7A. The corner members 26, 28 are rotational mounted on the top end of their respective uprights 14, 16, e. g., as shown in FIGS. 1 and 2.

In FIG. 3, part (B), there is shown an arrow simulating a force being applied to the cross bar 18 causing a separation of the bar portions 20, 22 and a rotation of the bar portions about the axis of the associated upright 14, 16. The force arrow represents a runner striking the cross bar 18 in an attempt to clear the hurdle assembly 10. Due to the friction fit of the attachment member 24 within the hollow ends of the bar members 20, 22, there is a relatively easy separation and pivoting of the two bars. Hence, the runner is able to practice with minimal resistance being applied against the force (arrow) of the strike. Referring again to FIG. 7A, the pivot of the bar member 22 occurs by its attachment to the corner member 26, which is fixed to the outer collar 30 and which is in turn slidingly positioned over the fixed post member 32. The collar 30 and post 32 are axially aligned and the inner diameter of the collar being greater than the outer diameter of the post 32. A similar arrangement for upright 14 with its corner member 28 is also contemplated.

As shown in FIG. 3, parts (A) and (B), forward projecting foot members 54, 56 are fixed to the respective base members 44, 46. The foot members 54, 56 are positioned opposite of the leg member 36, 38 on the base 12 of the assembly. The foot members 54, 56 are considered optional and serve to add resistance to forward movement and/or tilting of the assembly 10 during a striking force (e.g., the arrow in FIG. 3, part (B)). The foot members 54, 56 may also provide additional stability in windy conditions.

Figure 4:
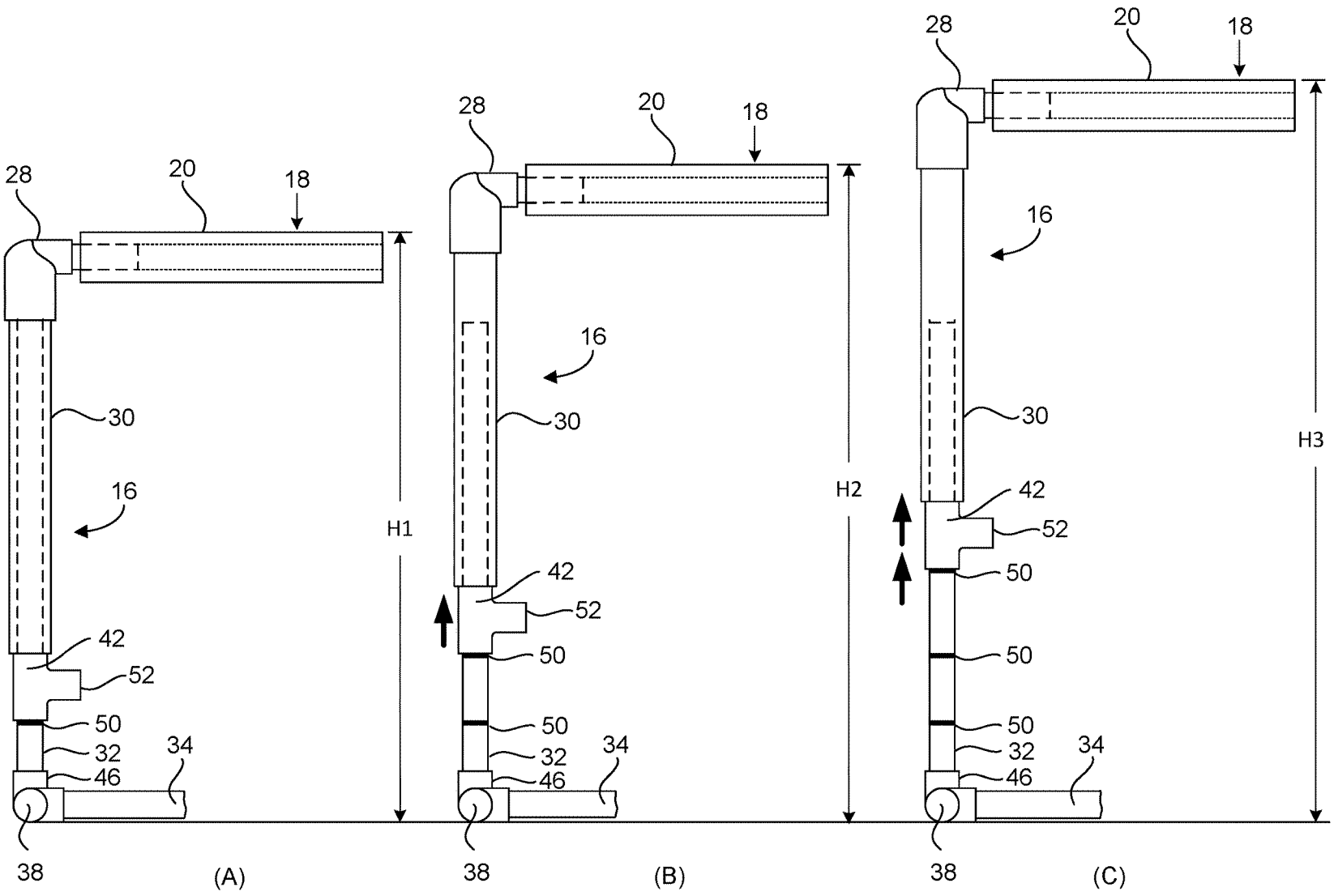
FIG. 4 shows a partial rear elevation view of the hurdle assembly, with the various parts (A), (B) and (C) showing the cross bar adjusted to heights H1, H2, and H3, respectively.
Figure 5:
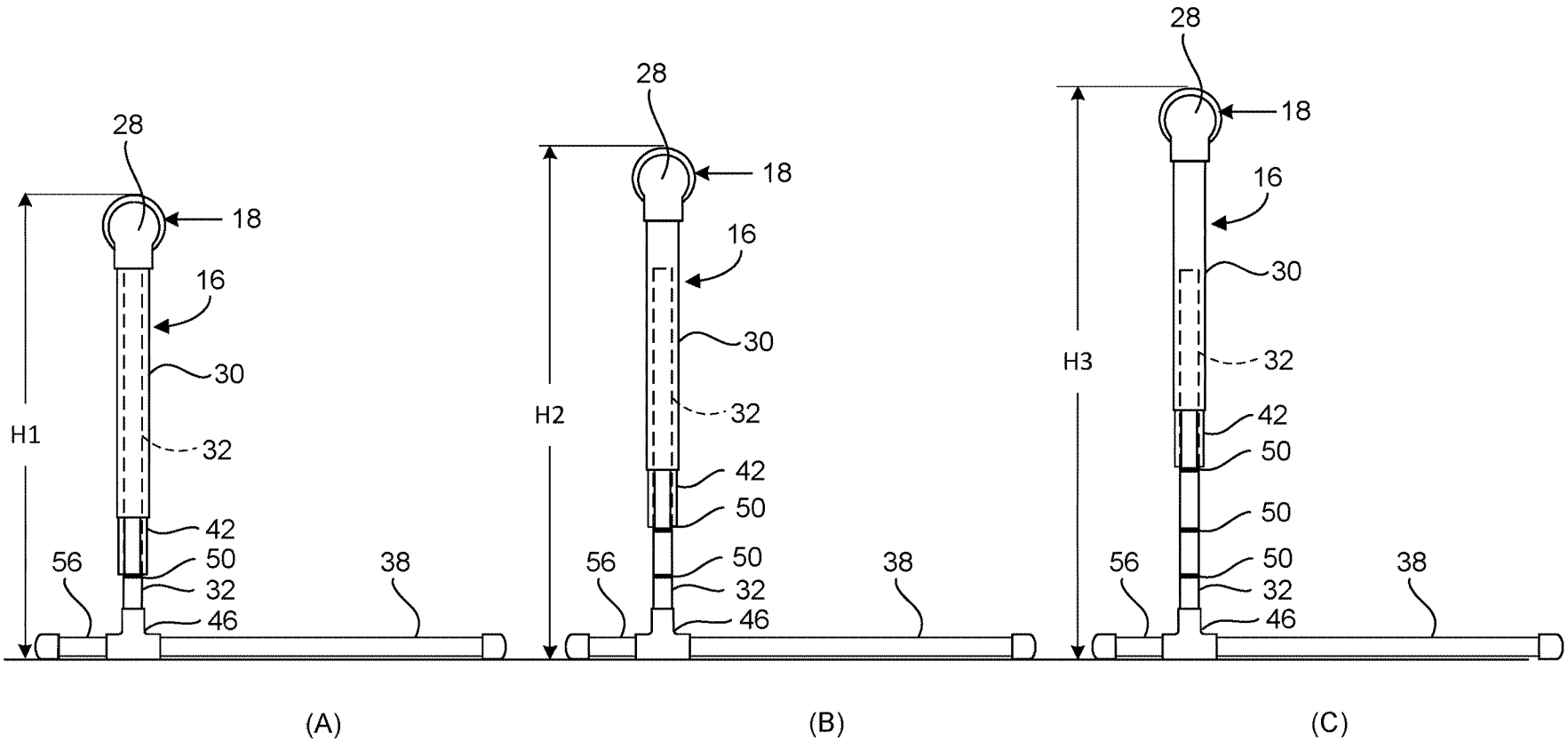
FIG. 5 shows a side elevation view of the hurdle assembly, with the various parts (A), (B) and (C) showing the cross bar adjusted to the heights H1, H2, and H3, respectively
Figure 6A:
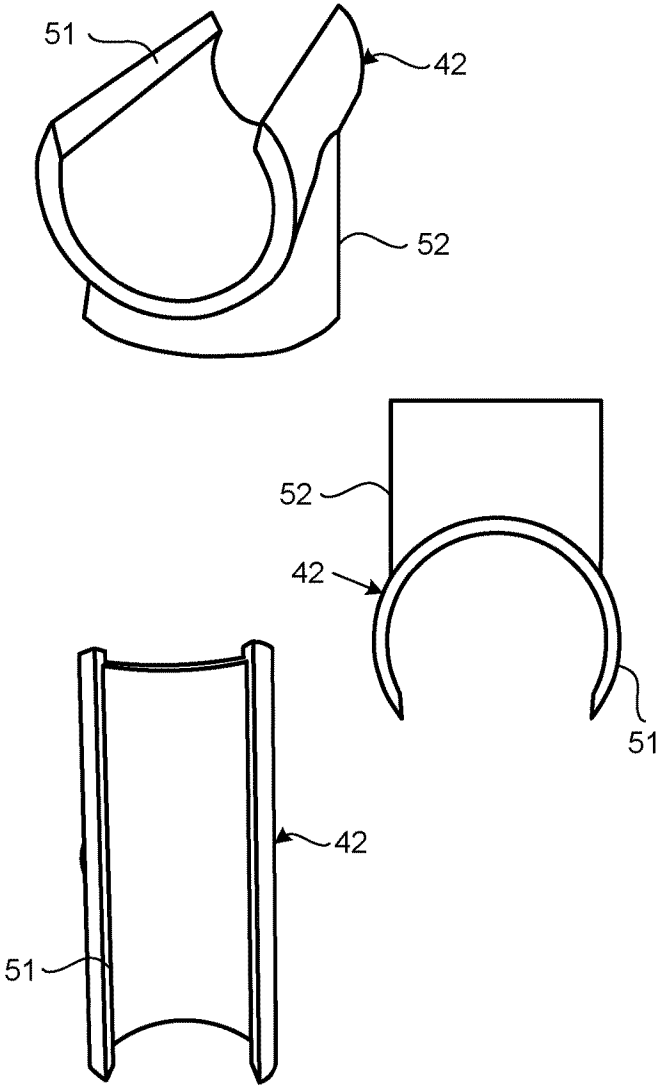
FIG. 6A shows various view of an adjustment clamp portion.

In FIGS. 4 and 5 there is shown height adjustment of the uprights 14, 16, to raise or lower the cross bar 18. The length of the uprights 14, 16, and thus the height of the cross bar 18, may be changed to match, for example, the age, height or skill level of the runner. Changing the height of the cross bar 18 is created by the movement of an adjustment member 42 on the post members 32. As shown in the figures, the adjustment member 42 is attached to the post member 32 at a position above the base member 46. The adjustment member 42 is shown in more detail in FIG. 6A as having an open c-shaped clamp portion 51. Clamp portion 51 is sized to engage with the post member 32. An opposing nub 52 is shown and may be provided so as to assist in the sliding movement of the adjustment member 42 along the post 32.

Referring to FIGS. 4 and 5, parts (A) thereof, the clamp 51 engages the post 32 and is set at a specific position, preferably marked by a reference line 50. A similar setting is provided for the adjustment member 42 on post 32 of upright 14. The bottom end of the collar 30 rests on adjustment member 42, which is fixed to the post 32. This arrangement in turn fixes the cross bar 18 to a height H1. In part (B) of these figures the member 42 is raised upwardly on the post 32 to a second reference line 50. This adjustment raises the cross bar 18 to a new height H2. In part (C), the adjustment member 42 is again raised to a third reference line 50 on the post 32 to push the collar 30 up further and set the cross bar to height H3.

In use, it is contemplated that the frictional engagement of the adjustment member 42 on the fixed post 32 is greater than the frictional engagement of the attachment member 24 within the hollow of the two bar portions 20, 22. The adjustment member 42 must support the weight of the collar, corner member and cross bar and maintain that position at the desired height. However, the engagement preferably permits a sliding adjustment along the post. Other adjustment control members and assemblies are possible.

Referring again to FIG. 7A, the pivot of the bar portion 22 occurs by its attachment to the corner member 26. The pivotal attachment of the corner member is formed by it being fixed to the outer collar 30. The collar is telescopically positioned over the post member 32 and thus may rotate about the vertical axis of the upright, which is formed by the post member 32. The dimensional relationship between collar 30 and post 32 allow the collar to rotate about the post 32.

Figure 7B:
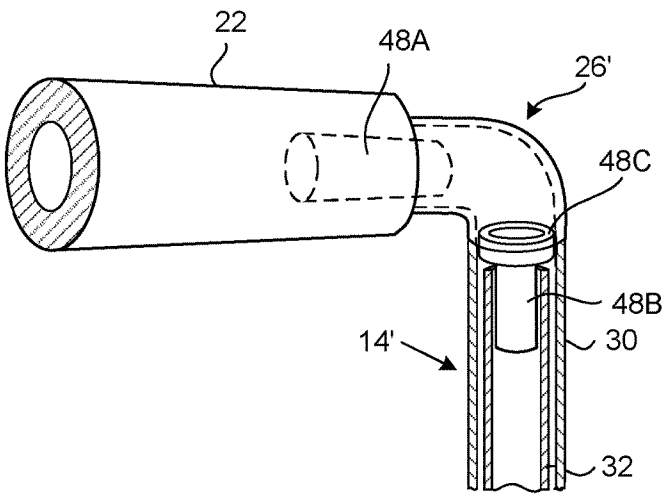
FIGS. 7A, 7B and 7C show various embodiments of a cross bar pivot assembly.
Figure 7C:
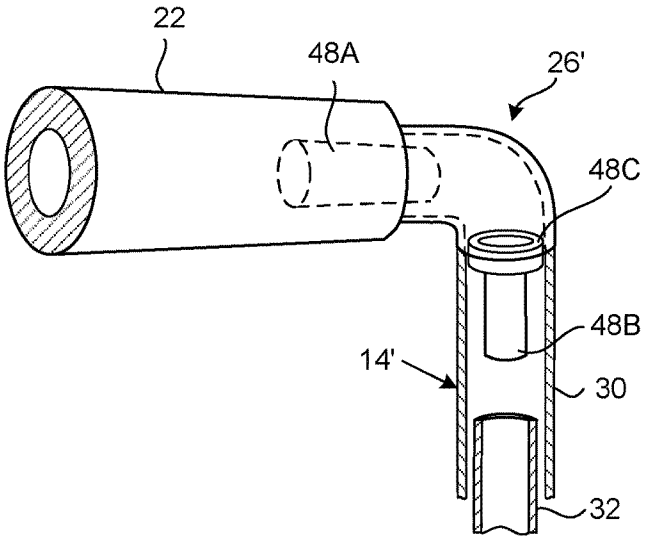

In FIGS. 7B and 7C, there is shown a potential alternate structure for the upright 14' and corner member 26'. As shown, the corner member 26' includes a lateral flange 48A, which is similar to the flange 48 in FIG. 7A. The lateral flange 48A is inserted into the interior of the bar member 22. The pivot attachment for the corner member 26' may be formed an insert flange 48C that is fixed to the corner member 26'. A projection 48B extends from the insert 48C in a downward direction. As shown, the outer dimension of the projection 48B is contemplated to be less than the inside dimension of the post 32. In FIG. 7B the projection 48B is positioned inside the post 30 and may rotate about the vertical axis of the post 32. The outer collar 30 abuts against the bottom surface of the corner member 26' and/or a shoulder formed by the insert 48C. In this arrangement, the corner member 26' may rotate about the axis of the upright. Along with the attached bar portion 22. The rotation of the corner member is independent of the collar 30 and the post 32. In FIG. 7B, the relative positioning of the parts is contemplated to correspond to the height H1 of FIGS. 4 and 5, parts (A). In FIG. 7C, the height of the cross bar is raised, such as to H2 of FIGS. 4 and 5, parts (B). The collar 30 has now moved vertically up the post 32 and there is a separation of the projection 48B from the top end of the post 32. In this FIG. 7C, the projection 48B continues to serve as the pivot attachment for the corner member and its associated bar portion.

In FIG. 7C, the corner member 26' is free to rotate either with the collar 30 or separately therefrom. It is contemplated that the arrangement of FIGS. 7A and 7B may be adapted for use in other upright and/or based structures. For example, in an existing hurdle structure, the fixed cross bar may be removed and the separable cross bar 18 may be attached to the existing uprights, with the corner member 26' positioning the cross bar 18 and permitting rotation. The dimensions of the flange member 48B and/or insert 48C may need to be conformed to the upright structure of the existing hurdle. An adaptor structure may also be added to accommodate different dimensions for the existing structures and to permit the corner member/cross bar combination to be moved from the assembly 10 to an existing structure.

Figure 7A:
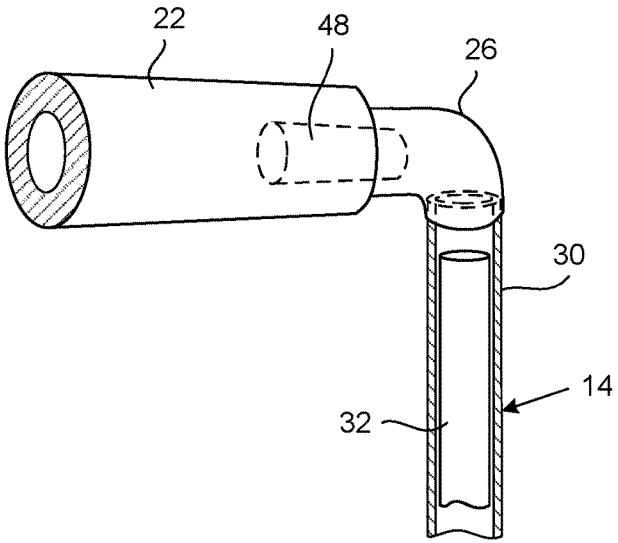
Figure 8:
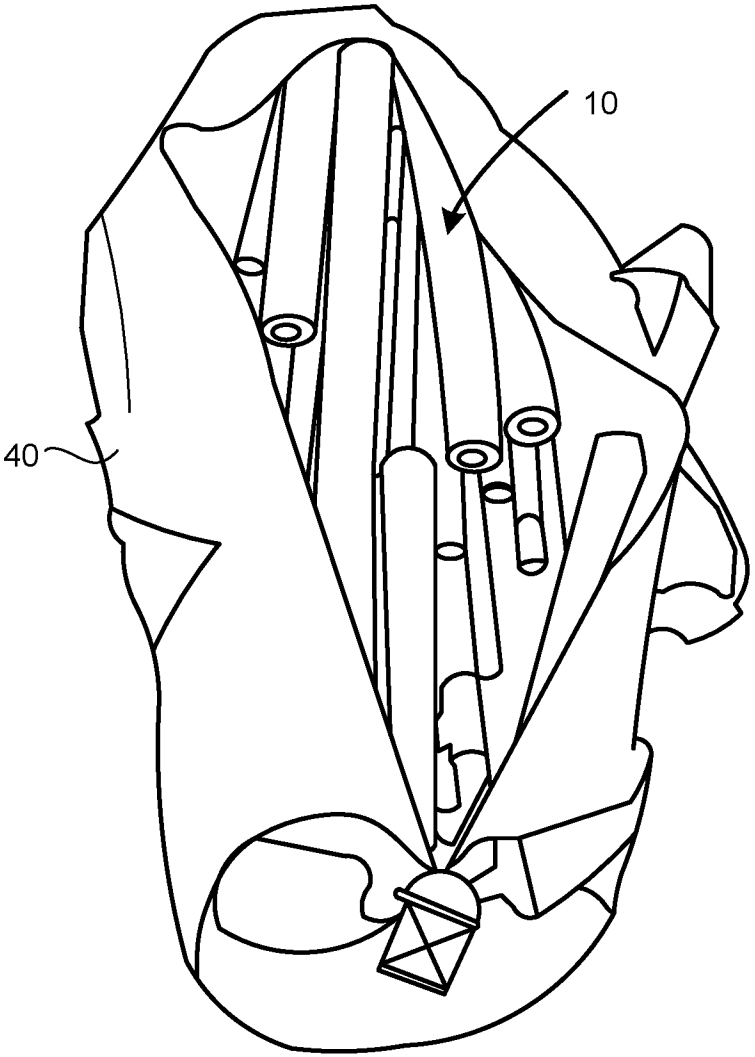
FIG. 8 shows one or more dismantled hurdles stored in a travel bag.

As shown in FIG. 8, the hurdle 10 may be dismantled/disassembled for storage and transport. As shown, preferably, one or more assemblies will fit within a small to medium duffle bag 40. The assembly is contemplated to be formed by frictional engagement of the parts. For example, the bottom bar 34 is inserted at opposite ends of the base members 44, 46. Leg members 36, 38 are also inserted into the respective base members 44, 46. If provided, foot members 54, 56 are inserted into the from end of the base members 44, 46. This sub-assembly forms the base 12 of the hurdle. To form the uprights 14, 16, post members 32 are inserted into and project upwardly from the base members 44, 46. Each collar 30 is slid over its respective post member 32 and may slide linearly along and rotate about the post member. A key or frictional element may be added to the overlap of the collars on the posts to restrict separation during, for example, movement of the hurdles from one position or location to another. In the embodiment of FIG. 7A, the collars are attached to their respective corner members 26, 28. The attachment may be a friction fit or may be fixed in other ways. The attachment connects the movement of the corner with that of its associated collar. As discussed previously, the assembly of the corners and uprights in the embodiment of FIGS. 7B and 7C is different, but still permits the bar members to rotate about the axis of the uprights, as defined by the post members 32. The length of the uprights may be defined by an adjustment member fit onto the post member. The adjustment member is secured to the post and supports the collar member, which sit on top of the adjustment member. The cross bar 18 is assembled from the two bar member portions 20, 22. One end of the bar member 20 is slid over a projecting flange 48 of the corner member 28. The second bar member 22 is similarly assembled. The two bar members 20, 22 are linearly aligned between the two corner members 26, 28. An attachment member 24 may be inserted into the center ends of the two bar members 20, 22 to form a releasable connection between the two bar portions.

In embodiments, the hurdle assembly may be constructed of common, relatively rigid, plastic pipe members, such a piping made from polyvinyl chloride (PVC) or other common materials. The cross bar may be formed by a foam pipe insulation material, made, for example, of a polyethylene material. Other materials and structures are possible, including polyethylene foam "pool noodles". preferably, the cross bar is made of a relative soft material, having sufficient stiffness and strength to form a linearly strait bar that extends between the uprights and that may withstand repeated contact during use.

The relative dimensions and frictional contact between the various members of the assembly may be adjusted for desired operation. For example, the bar members are attached to their respective corner members by the projecting flanges. The flanges are contemplated to be relatively longer than the central attachment member and may be inserted into the ends of the bar portions by a greater distance. For example, the flanges may extend approximately 2.5 inches from the corner holder, while the attachment member preferably extends approximately 0.5 inches into the ends of the two bar portions. Adjustments to the length and material of these elements may be made depending on the dimensions, physical attributes, and frictional properties of the relevant parts. This relationship leads to the bar portions to be temporarily fixed to one another and to easily separated at the center when being subject to a transverse or downward force during use.

Typically, a series of hurdle assemblies are lined up on a track in a spaced relationship. The runner is required to sprint along the track lane and jump over the hurdles in succession. The assembly as described herein provides the advantage of the cross bar 18 separating should the runner fail to clear a hurdle. The separation is preferably created with minimal transverse or downward contact and without abrasion being caused to the runner. The pivot around the fixed post members of each upright further adds to the ability of the bar portions to separate and pivot away from the center. Alternated adjustment mechanisms may also be included. A resilient return mechanism may be added for the automatic reset of the position of the bar members. Alternate forms of the attachment member may be used.

Other features and advantage of the assembly may become apparent by a review of the description above and the included illustrations.

What is claimed is:

1. A hurdle assembly comprising:

a base, two upright members, each respective upright member fixed on opposite sides of the base, a cross bar suspended between the two upright members, the cross bar having a first bar member and a second bar member, corner members, each pivotably supporting one of the bar members on a respective upright member, the first and second bar members positioned substantially perpendicular to the respective upright member, and a bar attachment releasably securing the first and second bar members together and in an end-to-end alignment, wherein a striking force on the cross bar causes a release of the bar attachment and a separation of the two bar members, with the two bar members pivoting on their corner member about a vertical axis of their respective upright members;

wherein the first and second bar members are made of a soft foam material, and wherein the first and second bar members have a hollow core and the bar attachment is positioned within the hollow core of each of the first and second bar members.

2. The hurdle assembly of claim 1, wherein each respective upright is fixed on an opposite side of the base.

3. The huddle assembly as in claim 1, wherein the upright members project substantially vertically from the base.

4. The hurdle assembly as in claim 1, wherein the corner members comprise a telescoping structure having an outer collar, wherein the upright members each include an inner post member, and wherein the outer collar is co-axially aligned with an inner post member.

5. The hurdle assembly of claim 4, wherein the inner post member of the upright members are fixed to the base, and wherein the base comprises a transverse bottom bar, a joint member attached at each end of the bottom bar and a leg member projecting rearwardly from each respective joint member.

6. The hurdle assembly of claim 5, wherein the base further comprises a foot member attached to at least one joint member, the foot member projecting forward of the corresponding base member.

7. The hurdle member of claim 4, further comprising a height adjustment member provided on at least one of the upright members, the height adjustment member frictionally engaged on an outer surface of the inner post member of the upright member, the height adjustment member in contact with and vertically supporting the telescoping outer collar of the corner member, the frictional engagement of the height adjustment member being releasable for adjusting the vertical position along the upright member.

8. The hurdle member of claim 4, wherein each corner member is fixed to the outer collar, with the outer collar capable of rotation about the vertical axis of the upright members formed by the corresponding post member.

9. The hurdle assembly as in claim 4, wherein the telescoping structure further comprises:

a friction element formed between each of the outer telescoping collars and inner post members, the friction element restricting separation of each respective collar and inner post member.

10. The hurdle assembly of claim 1, wherein each corner member is mounted on the respective upright member by a flange telescopically positioned with the upright member, and wherein the flange is capable of rotation about the vertical axis of the upright member.

11. The hurdle assembly of claim 1, wherein the respective first and second bar members are attached to the corresponding corner member by a friction fit.

12. The hurdle assembly as in claim 11, wherein the bar attachment comprises an insert positioned within projected ends and frictionally retained by the hollow core of the first and second bar members, and wherein the fiction fit of the bar members with the corner members is greater than the frictional securing of the insert within the hollow core of the bar members.

13. A hurdle assembly comprising:

a base, two upright members, each upright member vertically positioned on opposite sides of the base, a pair of corner pivot members, the corner pivot members positioning a respective bar member on a respective upright member, each corner pivot member comprising a telescoping structure having an outer collar co-axially aligned with an inner post member formed as part of the upright member, the coaxially aligned outer collar rotationally fixing the corner pivot member to the respective upright member, and wherein the outer collar is rotational about the vertical axis of the upright member, a cross bar suspended between the two upright members, the cross bar having a first bar member and a second bar member, one bar member fixed to one of the corner pivot members and pivotably supported on a respective upright member by the collar member of the corner pivot member, and the first and second bar members linearly aligned between their respective pivotal supports;

a bar attachment positioned on projected ends of the two bar members, the bar attachment releasably fixing the projected ends together and creating the linearly alignment of the first and second bar members, wherein a striking force on the cross bar causes a release of the bar attachment and a separation of the two bar members, and each bar member freely rotating in a horizontal plane about the vertical axis of their respective upright member.

14. The hurdle assembly as in claim 13, wherein the bar attachment comprises an insert positioned on the projected ends of the first and second bar members, the insert frictionally engaged with at least one of the two bar members to releasably fix the projected ends of the bar members.

15. The hurdle assembly as in claim 14, wherein the first and second bar members comprise a hollow core and the insert frictionally positioned within the hollow core of the at least one bar member.

16. The hurdle assembly as in claim 15, wherein the first and second bar members are made of a soft foam material.

17. The hurdle assembly of claim 13, further comprising a friction element formed between each of the telescoping collars and posts, the friction element restricting separation of the respective collars and posts.

18. A cross bar assembly to be attached to uprights of an existing hurdle assembly, the cross bar assembly comprising:

a first bar member and a second bar member, a pair of corner members, one bar member attached to one respective corner member, wherein the bar member projects horizontally from the corner member, a bar attachment positioned on projected ends of the two bar members and releasably securing the two bar members in an end-to-end linear alignment, between the two corner members, and a corner pivot formed as part of each of the corner members, the corner pivot rotationally mounting the at least one corner member to the upright member of the existing hurdle assembly, such that the corner member is capable of rotation about a vertical axis formed by the upright member of the existing hurdle assembly, the corner pivot including a collar telescopically fixing the corner member to the respective upright member of the existing hurdle assembly for the rotation about the vertical axis of the upright member, wherein a striking force on the releasably secured bar members causes a release of the of the bar attachment and a free rotation of the corner pivot about the vertical axis of the upright member of the existing hurdle assembly and a rotation of the bar members in a horizontal plane.

19. The cross bar assembly as in claim 18, wherein the bar members have a hollow tubular form.

20. The cross bar assembly as in claim 19, wherein the bar members are made of a soft foam material.

21. The cross bar assembly as in claim 19, wherein the bar attachment is inserted into and frictionally secured within the hollow of the projected ends of each bar member.

22. The cross bar assembly as in claim 18, wherein the bar attachment is frictionally engaged within the two bar members to releasably fix the projected ends of the first and second bar members.

* * * * *